US008047536B2

(12) United States Patent
Takemura

(10) Patent No.: US 8,047,536 B2
(45) Date of Patent: Nov. 1, 2011

(54) IMAGE FORMING APPARATUS

(75) Inventor: Masataka Takemura, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 190 days.

(21) Appl. No.: 12/511,299

(22) Filed: Jul. 29, 2009

(65) Prior Publication Data

US 2009/0278305 A1 Nov. 12, 2009

(30) Foreign Application Priority Data

Aug. 4, 2008 (JP) ..... 2008-200316

(51) Int. Cl.
*B65H 7/02* (2006.01)

(52) U.S. Cl. ..... 271/227; 271/228

(58) Field of Classification Search ..... 271/227, 271/228, 258.01

See application file for complete search history.

(56) References Cited

U.S. PATENT DOCUMENTS 7,775,518 B2 * 8/2010 Kondo ..... 271/227
7,900,913 B2 * 3/2011 Katou et al. ..... 271/227
2009/0066016 A1 * 3/2009 Kato et al. ..... 271/227
2010/0262277 A1 * 10/2010 Kondo ..... 700/213

FOREIGN PATENT DOCUMENTS

JP 2005-082342 3/2005

* cited by examiner

*Primary Examiner* — David H Bollinger
(74) *Attorney, Agent, or Firm* — Smith, Gambrell & Russell, LLP

(57) ABSTRACT

An image forming apparatus has a sheet feeding portion feeding a sheet; a conveyance passage for conveying the sheet inside the apparatus; an image forming portion forming an image on the sheet; a skewing detector disposed in the conveyance passage between the sheet feeding portion and the image forming portion, detecting arrival and departure of the sheet, and detecting skewing amount of the sheet in the conveyance passage; a display portion displaying an apparatus state; a storage portion storing data; and a control portion controlling sheet feeding and conveying, and grasping the sheet skewing amount based on the output of the skewing detector to stop printing when the skewing amount is at or above a first predetermined amount stored in the storage portion.

10 Claims, 9 Drawing Sheets

IMAGE FORMING APPARATUS

This application is based on Japanese Patent Application No. 2008-200316 filed on Aug. 4, 2008, the contents of which are hereby incorporated by reference.

BACKGROUND OF THE INVENTION

1. Field of the Invention

The present invention relates to an image forming apparatus, such as a copier, an MFP (multifunction printer, product, or peripheral), or printer, that forms an image by printing on, while conveying, a sheet of paper.

2. Description of Related Art

For example, in an image forming apparatus, such as a copier, an MFP, or a printer, sheets of paper fed from a sheet cassette or the like are conveyed inside the apparatus, are printed on, and are ejected out of the apparatus. During conveyance of a sheet, skewing may occur. Factors causing skewing include how sheets are placed in a cassette, how conveyance rollers and the like for conveyance of sheets are fitted, and secular changes due to wear in the conveyance rollers. A sheet in a skewed state is easily caught in a conveyance passage, or at a rotary member (such as a pair of conveyance rollers) along a conveyance path. When that happens, a jam (getting-stuck of a sheet) results. Thus, some image forming apparatuses are devised to reduce skewing of sheets.

For example, there is known a sheet conveying apparatus comprising: guide members disposed to face opposite edges of a sheet in the direction perpendicular to the sheet conveyance direction and movable between a position for guiding the sheet and a position for aligning its edges; a reference sensor capable of detecting the initial position of the guide members; and driving means for driving the guide members, the guide members being moved according to size of the sheet, wherein there is provided a controller of which the input is connected to sheet orientation detecting means, disposed on the upstream side of the guide members, for detecting skewing of the sheet traveling into the interval between the opposing guide members and of which the output is connected to the driving means for driving the guide members, and the controller, on detecting that the skewing of the sheet is excessive, i.e., out of a predetermined state, retracts the guide members outward from a position ready to receive the sheet. With this construction, it is possible, basically, to align the edges of a sheet to correct skewing and, when a sheet is en excessively skewed state, to prevent its collision with the guide members and thereby prevent damage to the sheet and to the sheet receiving part as may result when the sheet collides with the guide members.

It is true that, with the conventional sheet conveying apparatus described above, the guide members for aligning the edges of a sheet can correct skewing to a certain degree; however, when a sheet has a large amount of skewing, the guide members are retracted simply to prevent damage to them, and a jam eventually occurs. Even when the guide members are moved, such a jam as occurs when a sheet has a large amount of skewing tends, invariably, to be severe, resulting in the sheet being torn, being stuck in a way difficult to take out, or remaining inside the apparatus. Thus, the conventional technology has the disadvantage of being incapable of preventing a severe jam.

Moreover, the conventional technology requires arrangement of a skewing correction mechanism (such as guide members; driving means such as a motor, a gear, a guide rod, and a belt; and a plurality of sensors) along the conveyance passage. This skewing correction mechanism is complicated and expanded, and thus has the disadvantage of increasing the manufacturing costs of image forming apparatuses. In fact, such a mechanism has in practical terms almost no hope of being adopted in low-end models (low-price-range models). Moreover, for effective skewing correction with large-size sheets, the guide members need to be secured a sufficient movement stroke. This disadvantageously leads to larger apparatus sizes.

Furthermore, even though the conventional sheet conveying apparatus may reduce incidence of jams, once a jam occurs during simultaneous conveyance of a plurality of sheets inside the apparatus, as during continuous printing, the user always has to remove a plurality of sheets from the conveyance passage. Thus, disadvantageously, the aim there is not to alleviate the trouble of recovering from a jam, and the work itself for that, on the user's part.

SUMMARY OF THE INVENTION

In view of the above problems of the conventional technology described above, an object of the present invention is to detect how sheets are being conveyed and to predict the occurrence of a jam based on the results detected so as to take efficient measures to a jam.

To achieve the above object, according to one aspect of the invention, an image forming apparatus comprises a sheet feeding portion that accommodates a plurality of sheets as a recording medium and feeds a sheet; a conveyance passage through which the sheet is conveyed inside the apparatus; an image forming portion forming an image on the sheet; a skewing detector that is disposed in the conveyance passage between the sheet feeding portion and the image forming portion, and that detects arrival and departure of the sheet and in addition detects the amount of skewing of the sheet in the conveyance passage; a storage portion storing data; and a control portion that controls sheet feeding and sheet conveyance, and that in addition grasps the amount of skewing of the sheet based on the output of the skewing detector and stops printing when the amount of skewing is equal to or more than a first predetermined amount stored in the storage portion.

With a large amount of skewing of the sheet, a jam is highly likely to occur in the future; in addition, once a jam occurs, it tends to be severe, causing the sheet to be torn or remain inside the apparatus for instance. With the above configuration, however, when the amount of skewing obtained by use of the skewing detector is equal to or more than the first predetermined amount, the control portion stops printing. Thus, conveyance of the sheet can be stopped before a jam occurs. When a jam is detected, generally, printing is stopped, and, in fact, printing is stopped in the present invention, but here printing is stopped before the sheet gets stuck inside the conveyance passage or at a rotary member for sheet conveyance (e.g., with the sheet torn, or stuck in a bellows-like state) in a way difficult to remove. This allows easy removal of the sheet, and leads to a low jam incidence.

When a severe jam occurs, part of a torn sheet may remain deep inside the apparatus and keep being detected by a sensor or the like. This may make it impossible to revoke the jam state, or may cause a further jam. When this happens, the image forming apparatus continues being inoperative. Inconveniently, the user then needs to call a maintenance serviceperson for recovery. With the present invention, however, severe jams are unlikely to occur, and thus there is less likelihood of inoperativeness and less need to call a serviceperson, leading to increased convenience to the user.

On the downstream side of the image forming portion, there are provided many mechanisms for printing. A jam in a printing mechanism tends to take time and trouble for recovery from it. The skewing detector, however, is provided on the upstream side of the image forming portion with respect to the sheet conveyance direction. This makes it possible to stop printing before a jam occurs on the downstream side of the image forming portion. Moreover, a construction for preventing a jam can be built with a skewing detector, a control portion, etc., and there is no need for an expensive, space-consuming construction as required for moving guide members for instance. Thus, the present invention can be implemented at low cost.

DETAILED DESCRIPTION OF PREFERRED EMBODIMENTS

Hereinafter, with reference to FIGS. 1 to 7, a first embodiment of the present invention will be described, with an MFP (multifunction printer, product, or peripheral) 1 (corresponding to an image forming apparatus) taken up as an example. It should be understood that all features in the aspects of construction, arrangement, etc. mentioned in the description of this embodiment are merely examples and are in no way meant to limit the scope of the invention.

(Outlined Construction of MFP 1)

Figure 1:
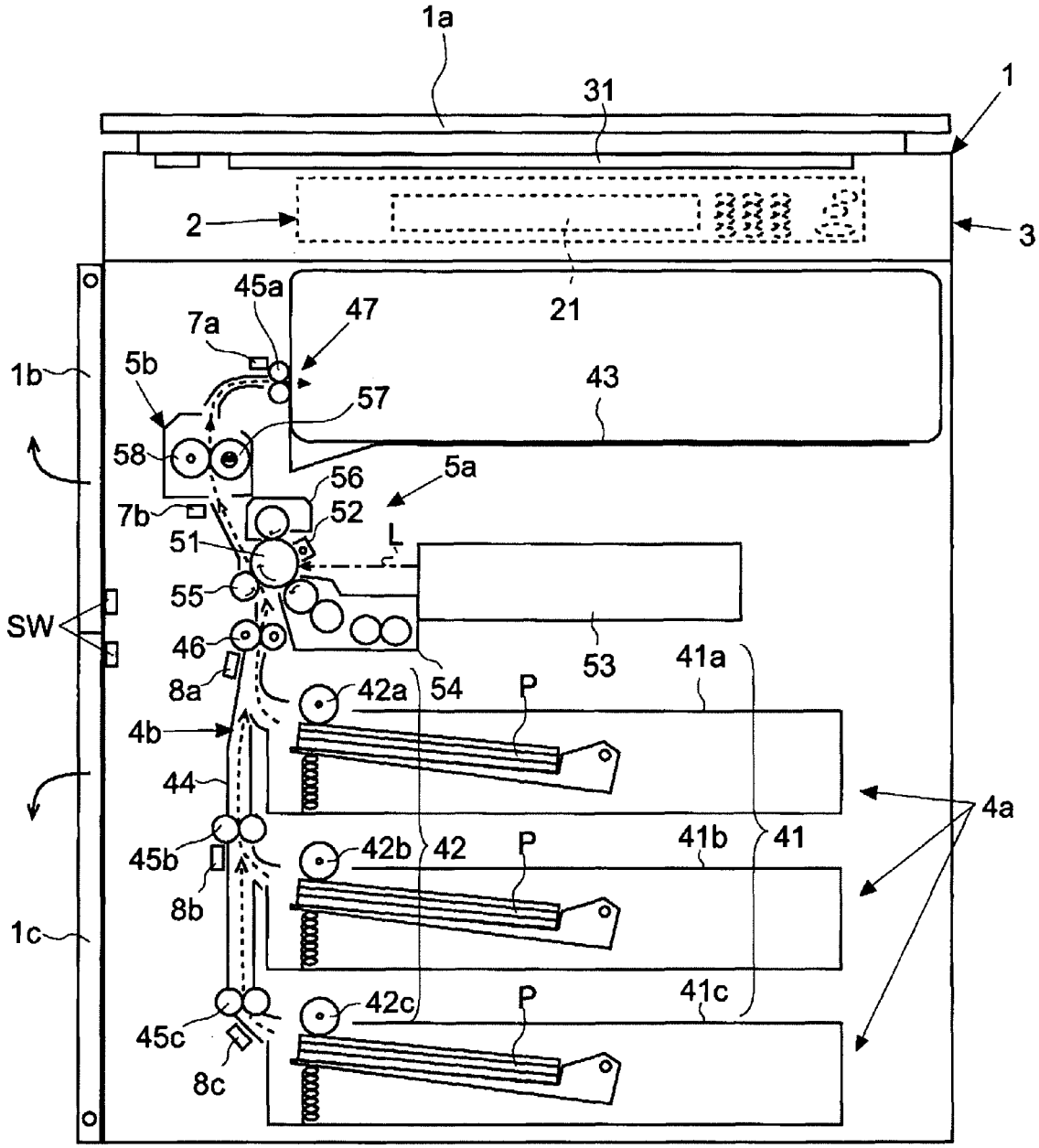
FIG. 1 is a schematic front sectional view of a MFP according to a first embodiment of the invention.

First, with reference to FIG. 1, an outline of the MFP 1 according to the first embodiment of the invention will be described. FIG. 1 is a schematic front sectional view of the MFP 1 according to the first embodiment of the invention.

As shown in FIG. 1, the MFP 1 of this embodiment has, in a top front part thereof, an operation panel 2 for function setting, and is, in a topmost part thereof, fitted with a document cover 1*a* for holding a document. Inside the chassis of the MFP 1, there are provided an image reading portion 3, a sheet feeding portion 4*a*, a conveyance passage 4*b*, an image forming portion 5*a*, a fixing portion 5*b*, etc. As shown in FIG. 1, for example, on a side face of the MFP 1, side covers 1*b* and lc are provided. The side covers 1*b* and lc can be opened and closed. With the side covers 1*b* and Ic open, the conveyance passage 4*b* is exposed, enabling recovery from a jam. There are also provided switches SW detecting whether or not they are open. In addition to the side covers 1*b* and 1*c*, a front cover (unillustrated) may also be provided for exposing a front part of the MFP 1.

During copying, the document cover 1*a* holds a document placed on a contact glass 31 provided on the top face of the image reading portion 3 as a document stage. To achieve that, the document cover 1*a* has a fulcrum at the far side thereof as seen in FIG. 1 so that it can be opened and closed in the upward and downward directions.

The image reading portion 3 reads a document and generates the image data of the document. On the top face of the image reading portion 3, the contact glass 31 is provided. Inside the image reading portion 3, there are provided optical system components (unillustrated) such as an exposure lamp, a mirror, a lens, an image sensor (e.g., a CCD). These optical system components are used to irradiate the placed document with light. The image reading portion 3 performs A/D (analog-to-digital) conversion on the output levels of the individual pixels of the image sensor receiving the light reflected from the document, and thereby generates the image data. The MFP 1 can print based on the image data thus read (copier capability).

The sheet feeding portion 4*a* accommodates a plurality of sheets P as a recording medium (e.g., sheets of any of various kinds of paper such as copying paper, plain paper, recycled paper, cardboard, and OHP transparencies). During printing, the sheet feeding portion 4*a* feeds sheets P by feeding them one by one into the conveyance passage 4*b*. The sheet feeding portion 4*a* is provided with a plurality of cassettes 41 (in this embodiment, three of them 41*a*, 41*b*, and 41*c*) in each of which sheets P are stacked. The cassettes 41 are provided with sheet feed rollers 42 (three of them, 42*a*, 42*b*, and 42*c*) respectively that rotate to feed sheets P into the conveyance passage 4*b*. For example, during copying, one of the sheet feed rollers 42 rotates so that sheets P needed for image formation are fed one by one into the conveyance passage 4*b*.

The conveyance passage 4*b* is a passage through which sheets P are conveyed from the sheet feeding portion 4*a* to an ejected sheet tray 43 inside the apparatus. Along the conveyance passage 4*b*, there are provided guide plates 44 for guiding sheets P, a plurality of pairs of conveyance rollers 45 (in FIG. 1, a total of three pairs of them 45*a*, 45*b*, and 45*c* are shown from top) that rotate during sheet conveyance, a pair of resist rollers 46, etc. The pair of resist rollers 46 keeps a conveyed sheet P on stand-by in front of the image forming portion 5*a*, then to feed it out with proper timing with toner image formation.

The image forming portion 5*a* forms a toner image based on the image data, and transfers the toner image onto a conveyed sheet P. To achieve that, the image forming portion 5*a* has a photoconductive drum 51 supported to be rotatable in the direction indicated by an arrow in FIG. 1. Around the photoconductive drum 51, there are arranged a charger unit 52, an exposure unit 53, a developer unit 54, a transfer roller 55, a cleaner unit 56, etc.

The toner image formation and transfer processes will now be described. The photoconductive drum 51 rotates in a predetermined direction about substantially the center of the image forming portion 5*a*. In FIG. 1, the charger unit 52 to the top-right of the photoconductive drum 51 charges the photoconductive drum 51 at a predetermined potential. The exposure unit 53 to the right of the charger unit 52 outputs laser light L based on the image data, and scans with it and thereby exposes the surface of the photoconductive drum 51 to form an electrostatic latent image based on the image data. Used as the image data is, for example, image data obtained by the image reading portion 3, or image data transmitted from a user terminal 100 connected over a network or the like or from a communication partner's facsimile machine 200 (see FIG. 3). The developer unit 54 to the bottom-right of the photoconductive drum 51 feeds toner to the electrostatic latent image formed on the photoconductive drum 51 to develop it. The transfer roller 55 to the left of the photoconductive drum 51 is pressed against the photoconductive drum 51 to form a nip. With proper timing with the toner image, the pair of resist rollers 46 feeds a sheet P into the nip. When the sheet P and the toner image enter the nip, the transfer roller 55 has a predetermined voltage applied to it, so that the toner image on the photoconductive drum 51 is transferred onto the sheet P. The cleaner unit 56 cleans the photoconductive drum 51 of toner and the like remaining on it after transfer.

The fixing portion 5*b* fixes the toner image transferred onto the sheet P. In this embodiment, the fixing portion 5*b* mainly comprises a heating roller 57, incorporating a heater, and a pressing roller 58. The pressing roller 58 is pressed against the heating roller 57 to form a nip. While the sheet P passes through the nip, the toner is fused and heated, so that the toner image is fixed on the sheet P. The sheet P after toner fixing is ejected into the ejected sheet tray 43. Image formation (printing) is performed in this way when the copier or printer capability is used.

(Operation Panel)

Figure 2:
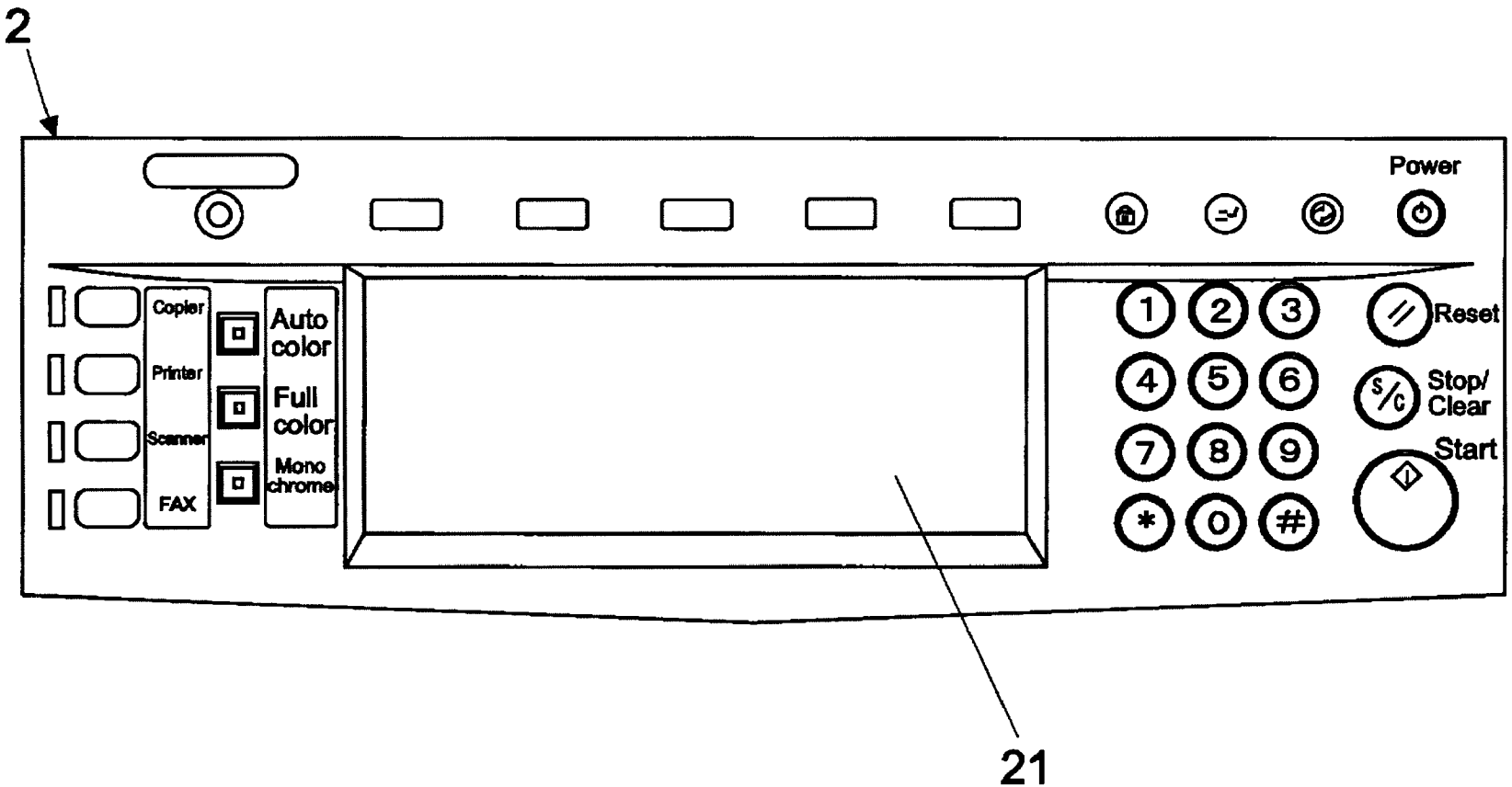
FIG. 2 is a plan view showing an example of an operation panel of the first embodiment.

Next, with reference to FIGS. 1 and 2, the operation panel 2 according to the first embodiment of the invention will be described. FIG. 2 is a plan view showing an example of the operation panel 2 according to the first embodiment of the invention.

As shown in FIGS. 1 and 2, the operation panel 2 provided in a top front part of the MFP 1 is provided with a liquid crystal display portion 21 (liquid crystal panel) of a touch panel type. The liquid crystal display portion 21 displays the state of the MFP 1 and various messages. For example, the liquid crystal display portion 21 indicates occurrence of errors such as a jam of a sheet P and running-out of sheets, and indicates, on occurrence of a failure, a need for a service call to call a serviceperson for maintenance. Moreover, the liquid crystal display portion 21 displays, in addition to messages, one or more keys for function selection and setting. The user can, by pressing the keys displayed on the liquid crystal display portion 21, make various settings on the functions of the MFP 1. Whenever a key is pressed, it is so identified on the touch panel.

(Hardware Configuration)

Figure 3:
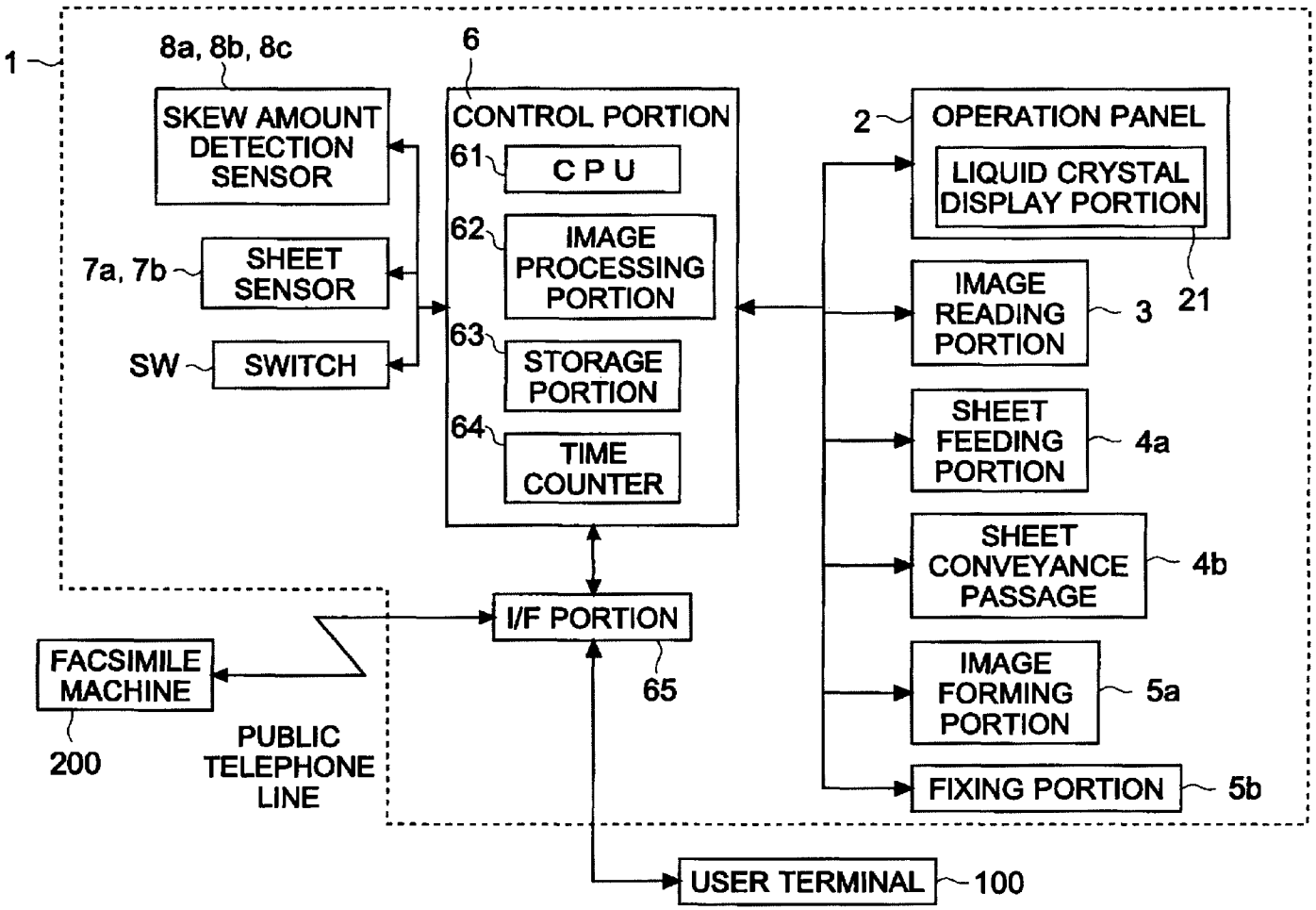
FIG. 3 is a block diagram showing an example of the configuration of the MFP of the first embodiment.

Next, with reference to FIG. 3, the hardware configuration of the MFP 1 according to the first embodiment of the invention will be described. FIG. 3 is a block diagram showing an example of the configuration of the MFP 1 according to the first embodiment of the invention.

Inside the MFP 1, a control portion 6 is provided. The control portion 6 controls the operation (including sheet feeding and sheet conveyance) of the MFP 1. The control portion 6 comprises, for example, a CPU 61, an image processing portion 62, a storage portion 63, etc. The CPU 61 is a central processing unit, and controls different parts of the MFP 1 based on control programs stored and mapped in the storage portion 63. The image processing portion 62 performs various kinds of image processing on image data read by the image reading portion 3, image data to be printed, and image data to be transmitted to the user terminal 100 or to the communication partner's facsimile machine 200. The storage portion 63 comprises a combination of non-volatile and volatile storage devices such as a ROM, a RAM, and a HDD. The storage portion 63 can store the control programs of the MFP 1 and various kinds of data such as control data, settings data, and image data. A time counter 64 counts times as needed to control the MFP 1, such as for sheet feed timing control and jam occurrence detection.

The control portion 6 is connected by signal lines or the like to different parts, such as the operation panel 2, the image reading portion 3, the sheet feeding portion 4*a*, the conveyance passage 4*b*, the image forming portion 5*a*, and the fixing portion 5*b*, and controls the operation of the MFP 1. The control portion 6 is connected to an I/F portion 65 (interface portion) provided with various connectors, sockets, and the like. The I/F portion 65 is connected via a network or a public telephone line to a plurality of user terminals 100 (only one of them is shown in FIG. 3 for convenience sake) and to a communication partner's facsimile machine 200. Thus, for example, image data obtained by the image reading portion 3 can be transmitted to the user terminal 100 or to the communication partner's facsimile machine 200 (which may be an internet facsimile) (scanner and facsimile capabilities). Moreover, printing, facsimile transmission, and the like are possible based on image data transmitted from the user terminal 100 or from the communication partner's facsimile machine 200 (printer and facsimile capabilities).

(Jam Occurrence Detection and Skew Amount Detection)

Figure 4A:
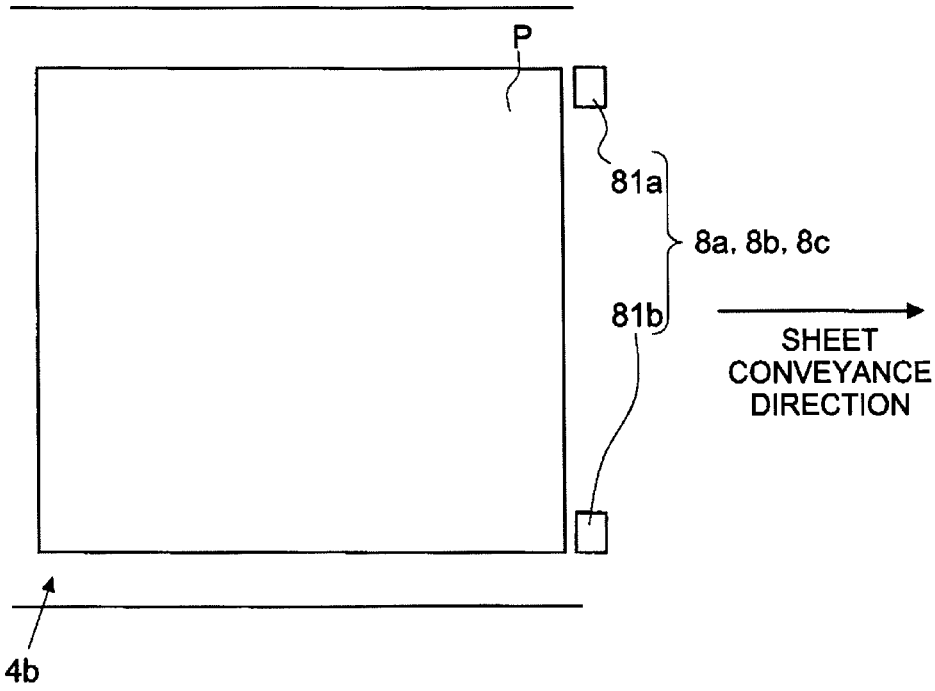
FIGS. 4A and 4B are diagrams showing an example of the arrangement for skew amount detection according to the first embodiment, with FIG. 4A showing a normal state and FIG. 4B showing an example of a skewed state.
Figure 4B:
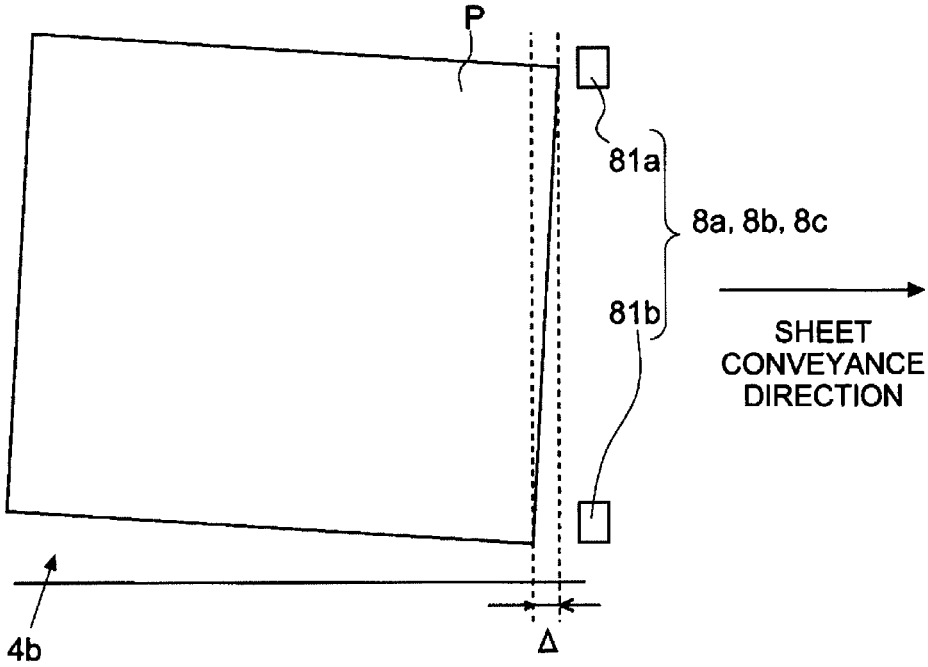

Next, with reference to FIGS. 1, 3 and 4, a description will be given of skew amount detection and jam detection during sheet feeding and sheet conveyance in the MFP 1 according to the first embodiment of the invention. FIGS. 4A and 4B are diagrams showing an example of the arrangement for skew amount detection according to the first embodiment of the invention, with FIG. 4A showing a normal state and FIG. 4B showing an example of a skewed state.

First, with reference to FIG. 1, various sensors for sheet conveyance control in the MFP 1 of this embodiment will be described. As shown in FIG. 1, in the MFP 1 of this embodiment, a plurality of sensors are provided along the conveyance passage 4*b*. For example, at a sheet eject opening 47 and near an upstream-side part of the fixing portion 5*b* with respect to the sheet conveyance direction, sheet sensors 7 are provided respectively (corresponding to a sheet detector; in FIG. 1 identified by 7*a* and 7*b* from top). Moreover, between the different tiers of the sheet feeding portion 4*a* and the pair of resist rollers 46, a plurality of skew amount detection sensors 8 (corresponding to a skew detector) are provided respectively (in FIG. 1, identified by 8*a*, 8*b*, and 8*c* from top).

For example, the sheet sensors 7 are optical sensors of a transmissive or reflective type. The sheet sensors 7 detect arrival and departure of a sheet P. In the MFP 1 of this embodiment, two of the sheet sensors 7 are provided; however, more of them may be provided, or one of them may be omitted; that is, how many of them to provide may be determined as necessary. For example, the sheet sensor 7 can be built with a light-emitting portion, such as an LED, and a light-receiving portion, such as a photodiode, arranged face to face with a light-shielding plate interposed between them which, on contact with a conveyed sheet P, swings in the direction parallel to the sheet conveyance direction of the sheet P. With this sheet sensor 7, when a conveyed sheet makes the light-shielding plate swing, the light stops being shielded, causing a change in the output (voltage, current) of the light-receiving portion. The sheet sensor 7 may instead be composed of a light-emitting portion and the light-receiving portion provided on opposite sides of a conveyed sheet P, so that while a sheet P is being conveyed between them, light is shielded from entering the light-receiving portion. So long as it can detect presence of a sheet P, the sheet sensor 7 is not limited to an optical sensor.

As shown in FIG. 3, the outputs of the sheet sensors 7 (7*a* and 7*b*) are fed to the control portion 6. Based on changes in the outputs of the sheet sensors 7, the control portion 6 recognizes arrival of a sheet at the positions at which the sheet sensors 7 are disposed. Also, based on changes in the outputs of the sheet sensors 7, the control portion 6 recognizes the rear end of a sheet leaving their respective detection regions, i.e., departure of a sheet from the positions at which the sheet sensors 7 are disposed. This enables the control portion 6 to grasp how a sheet is being conveyed.

Next, the skew amount detection sensors 8 will be described. First, the skew amount detection sensors 8 are provided along the conveyance passage 4*b* between the sheet feeding portion 4*a* and the image forming portion 5*a*. The skew amount detection sensors 8 detect arrival and departure of a sheet P, and in addition detect the amount of skewing of the sheet P in the conveyance passage 4*b*. As shown in FIG. 1, the skew amount detection sensors 8 are disposed on the upstream side of the pair of resist rollers 46 with respect to the sheet conveyance direction, at positions immediately after sheet feeding from each cassette 41 (in FIG. 1, identified by 8*a*, 8*b*, and 8*c*). Thus, the skew amount detection sensors 8 detect the amount of skewing of the sheet P immediately after its feeding. In this embodiment, as shown in FIG. 1, three of the skew amount detection sensors 8, namely 8*a* to 8*c*, are provided; instead, for example, only one such sensor may be provided at a position after confluence of sheets P from the different cassettes 41 (e.g., only 8*a* in FIG. 1).

A specific example of the arrangement of the skew amount detection sensor 8 will now be described with reference to FIG. 4. As shown in FIGS. 4A and 4B, the skew amount detection sensor 8 can be built with two sensors 81*a* and 81*b* (e.g., optical sensors) detecting arrival of a sheet P at two points near both sides of the conveyance passage 4*b* on a single line perpendicular to the sheet conveyance direction. For example, these sensors 81*a* and 81*b* may be of similar type to the sheet sensors 7 described above. So long as arrival and departure of a sheet P can be detected, there is no particular restriction. Although this embodiment deals with an example where the two sensors 81*a* and 81*b* are disposed at positions where they detect opposite edges of a sheet P of the maximum printable size, the two sensors 81*a* and 81*b* may instead be disposed nearer the center so that they can detect the amount of skewing of a sheet P of a smaller size. In addition to the sensors 81*a* and 81*b*, one or more other sensors may be arranged.

As shown in FIG. 3, the outputs (voltages, currents) of the sensors 81*a* and 81*b* composing the skew amount detection sensors 8 are fed to the control portion 6. Based on the outputs from the skew amount detection sensors 8, for example, the CPU 61 in the control portion 6 grasps the amount of skewing of a conveyed sheet P.

FIG. 4A shows a state in which the sheet P has no, or substantially no, skewing, i.e., a normal sheet conveyance state. The sensors 81*a* and 81*b* composing the skew amount detection sensor 8 switch their outputs simultaneously, or substantially simultaneously. This enables the CPU 61 in the control portion 6 to recognize that a sheet P is being conveyed with no significant skewing. The skew amount detection sensors 8 detect arrival of a sheet; the skew amount detection sensors 8 also detect departure of a sheet. Thus, the functions of the skew amount detection sensors 8 encompass those of the sheet sensors 7. By monitoring the outputs of the skew amount detection sensors 8, as with the sheet sensors 7, the control portion 6 can grasp how a sheet is being conveyed between the sheet feeding portion 4*a* and the pair of resist rollers 46.

On the other hand, FIG. 4B shows an example of a case where the sheet P is skewed. In this case, the sensors 81*a* and 81*b* composing the skew amount detection sensor 8 register arrival of a sheet at their respective detection regions at different time points. Thus, there is a time difference between changes in the outputs of the sensors 81*a* and 81*b*. The control portion 6 makes, for example, the time counter 64 count the time from the switch of the output of one sensor to the switch of the output of the other sensor. Moreover, the control portion 6 controls sheet conveyance, and grasps the sheet conveyance speed by controlling, for example, the rotation speed (circumferential velocity) of the motor (unillustrated) for rotating the pairs of conveyance rollers 45. Thus, by multiplying the time difference by the sheet conveyance speed, the control portion 6 can calculate the difference between the positions of the opposite corners of the front end of a sheet P in the direction parallel to the sheet conveyance direction, i.e., the amount of skewing (in FIG. 4B, indicated by Δ). Since the intervals between different skew amount detection sensors 8 and between the sheet sensors 7 are fixed, the sheet conveyance speed can be calculated by dividing a sensor-to-sensor interval (distance) by the time required to travel from the first sensor to the second.

The greater the time difference between changes in the outputs of the sensors 81*a* and 81*b*, the greater the skewing of a sheet P. Thus, the time difference itself can be used as the amount of skewing.

Next, an example of jam occurrence detection in the MFP 1 of this embodiment will be described. The control portion 6 monitors the outputs of the skew amount detection sensors 8 and the sheet sensors 7. For example, when none of the skew amount detection sensors 8 and the sheet sensors 7 detect arrival of a sheet P at a time that it ought to, the control portion 6 can recognize occurrence of a jam. Likewise, when none of the skew amount detection sensors 8 and the sheet sensors 7 detect departure of a sheet P at a time that it ought to, the control portion 6 can recognize occurrence of a jam. That is, the control portion 6 detects occurrence of a jam by the skew amount detection sensors 8 and the sheet sensors 7. The control portion 6 may make the time counter 64 count time, or it may use the time counting capability of the CPU 61 when it has one. When the control portion 6 recognizes occurrence of a jam, it stops all printing operation including sheet conveyance, sheet feeding, and image formation. Moreover, the control portion 6 makes the liquid crystal display portion 21 on the operation panel 2 indicate occurrence of the jam to notify the user of it.

In jam recovery work, the user opens the side covers 1*b* and 1*c*, the front cover (unillustrated) etc. of the MFP 1 to expose the conveyance passage 4*b*. Then the user removes all sheets P remaining in the conveyance passage 4*b*, including the sheet P that has caused the jam. Thereafter, the control portion 6 detects, by the switches SW (for example, interlock switches), that the covers are closed. Furthermore, the control portion 6 confirms, by the sheet sensors 7 and the skew amount detection sensors 8, that there is no sheet P in the conveyance passage 4*b*. On confirmation of all this, the control portion 6 revokes the jam state, and restarts printing.

Now, the reasons that the amount of skewing is detected in the MFP 1 of this embodiment will be described. First, a large amount of skewing of a sheet P leads to a high incidence of jams. Second, a large amount of skewing tends to make a jam severe, causing a sheet P to be torn or otherwise remain inside the apparatus for instance, and thus requiring a troublesome, time-consuming recovery. For these reasons, in the MFP 1 of this embodiment, the amount of skewing of a sheet P is detected, and printing operation is controlled to be varied according to the amount of skewing—a feature characterizing this embodiment, which will be described below.

(Sheet Conveyance Control According to Skew Amount)

Figure 5:
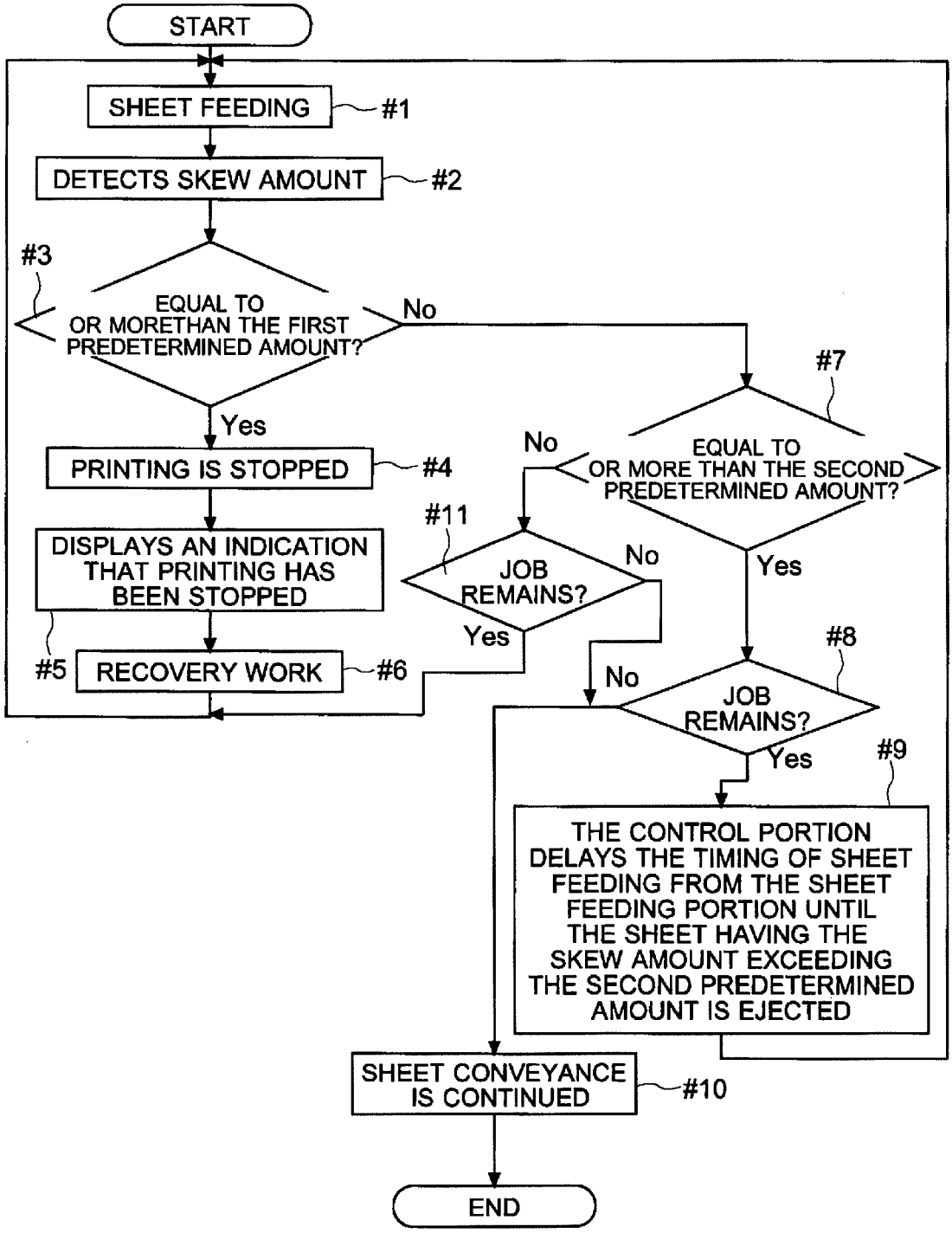
FIG. 5 is a flow chart showing an example of basic sheet conveyance control according to the first embodiment.
Figure 6A:
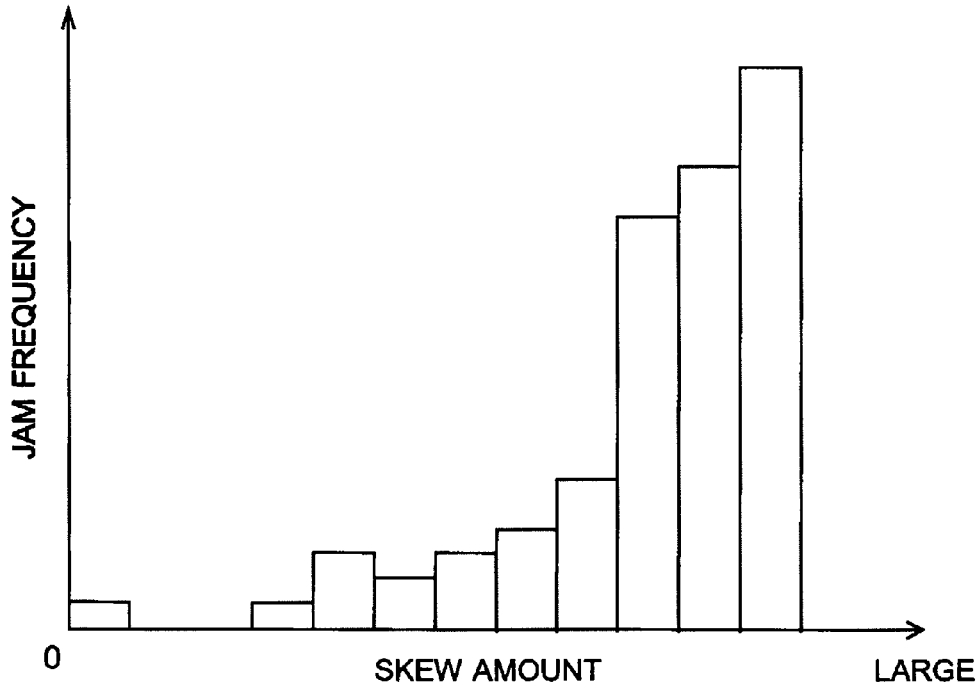
FIG. 6A is a graph showing an example of frequency of jams versus amount of skewing.
Figure 6B:
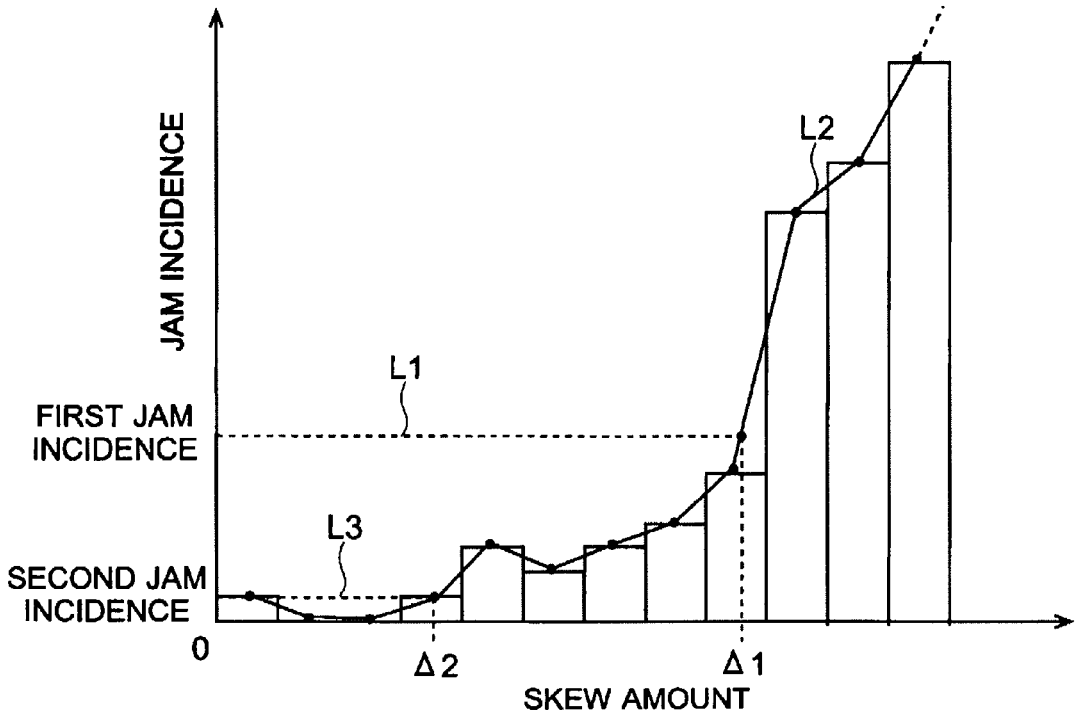
FIG. 6B is a graph showing an example of how a predetermined amount is found from the frequency of jams.

With reference to FIGS. 5 and 6, basic sheet conveyance control according to amount of skewing according to the first embodiment of the invention will be described. FIG. 5 is a flowchart showing an example of basic sheet conveyance control according to the first embodiment of the invention. FIG. 6A is a graph showing an example of frequency of jams versus amount of skewing. FIG. 6B is a graph showing an example of how a predetermined amount is found from the frequency of jams.

The "START" in FIG. 5 is when, while the MFP 1 is in a stand-by state, a command to execute printing is entered into it, as when the operation panel 2 is so operated as to enter a command to start copying, or when image data is transmitted from the user terminal 100 to make the MFP 1 function as a printer. Next, in response to the command to execute printing, the control portion 6 makes the image forming portion 5*a* start to form a toner image, and makes one of the cassettes 41 (41*a*, 41*b*, 41*c*) start sheet feeding; thus, the sheet feeding portion 4*a* executes sheet feeding (step #1). Next, the control portion 6 detects and grasps, by the skew amount detection sensors 8, the amount of skewing of the sheet P thus fed (step #2). Next, the control portion 6 checks whether or not the amount of skewing is equal to or more than a first predetermined amount Δ1 (step #3).

Here, with reference to FIG. 6, an example of the method for determining the first predetermined amount Δ1 will be described. FIG. 6A is a histogram showing an example of the relationship between the amount of skewing of a sheet P, as found by printing on a fixed number of sheets in previously conducted experiments or the like, and the frequency of jams.

In FIG. 6A, the amount of skewing is taken along the horizontal axis, and the frequency (number of occurrence) of jams is taken along the vertical axis. Here, the width of each bar, i.e., the step width of skew amount per bar, can be determined, for example, in a range of tenths of a millimeter to tens of millimeters as necessary. The number of bars (in FIG. 6A, 12 steps) can be set as necessary. For example, when it is assumed that the amount of skewing falls within the range of 0 to 6.0 cm, dividing the range into 12 steps gives the step width of skew amount per bar (the bar width) as 6.0 cm/12=5.0 mm. For each step width (e.g., 5 mm) of skew amount, the number of occurrence of jams is accumulated. As shown in FIG. 6A, the larger the amount of skewing, the more likely a sheet P is to be caught in the fixing portion 5*b*, at a rotary member such as the photoconductive drum 51, the transfer roller 55, and the pairs of conveyance rollers 45, and in the conveyance passage 4*b*. This leads to an increased number of occurrences of jams.

FIG. 6B is a graph showing the incidence of jams as calculated, based on the histogram created in FIG. 6A, by dividing the accumulated number of occurrence of jams by the total number of sheets printed thus far. In this graph, to ease understanding, the points at the center of the top of each bar are connected to draw a graph showing the relationship between skew amount and jam incidence. The graph may be drawn by connecting the points by a smooth curve such as a Bézier curve.

In the graph, the first predetermined amount of skew amount is identified by Δ1. The first predetermined amount Δ1 is determined based on a first jam incidence that can be arbitrarily determined. Specifically, in FIG. 6B, the value of skew amount at the intersection between the line L1 parallel to the horizontal axis and indicating the first jam incidence and the line L2 indicating jam incidence versus skew amount is the first predetermined amount Δ1. Here, the points through which the line L2 passes have known coordinates, and the linear functions representing the line segments connecting those points can be easily found.

Accordingly, based on the functions and their respective domains of definition with respect to those lines, the first predetermined amount Δ1 corresponding to the first jam incidence can be found. As mentioned above, the first jam incidence is arbitrarily determined. For example, the first jam incidence is determined with reference to the jam incidence stated to be attained in the specifications (e.g., when one jam for every 1000 sheets printed, 1/1000==0.1%). The first predetermined amount Δ1 thus statistically found is stored as an initially set value in the storage portion 63.

Back in FIG. 5, when the amount of skewing is equal to or more than the first predetermined amount Δ1 ("Yes" at step #3), to prevent aggravating recovery from a jam due to occurrence of a severe jam or the like, the control portion 6 stops printing operation (step #4). Specifically, when the amount of skewing grasped by use of the skew amount detection sensors 8 is equal to or more than the first predetermined amount Δ1 stored in the storage portion 63, the control portion 6 stops printing. The control portion 6 then makes the liquid crystal display portion 21 on the operation panel 2 display an indication that printing has been stopped (step #5). Specifically, when the amount of skewing grasped by use of the skew amount detection sensors 8 is equal to or more than the first predetermined amount Δ1 and thus printing is stopped, the control portion 6 makes the display portion display an indication that a sheet P having an amount of skewing equal to or more than the first predetermined amount Δ1 needs to be checked.

Thereafter, on completion of recovery work by the user, such as removal of the sheet P and checking of the sheet stack position inside the cassettes 41 (step #6), a return is made to step #1. This prevents occurrence of a jam on the downstream side of the image forming portion 5*a* which may aggravate recovery. Moreover, it is possible, before occurrence of a severe jam, to open the side covers 1*b* and 1*c* etc. and remove the sheet P comparatively easily. Moreover, since no severe jam occurs, there is much less need for time and trouble or to call a serviceperson.

On the other hand, when the amount of skewing is less than the first predetermined amount Δ1 ("No" at step #3), the control portion 6 checks whether or not the amount of skewing is equal to or more than a second predetermined amount Δ2 (step #7). Here, with reference to FIG. 6B, an example of the method for determining the second predetermined amount Δ2 will be described.

First, the second predetermined amount Δ2 is determined based on a second jam incidence that can be arbitrarily determined. Specifically, in FIG. 6B, the value of skew amount at the intersection between the line L3 parallel to the horizontal axis and indicating the second jam incidence and the line L2 indicating jam incidence versus skew amount is the second predetermined amount Δ2. It is preferable that the second jam incidence, which is arbitrarily determined, has a sufficiently small value, for example one-severalth to one-several-tenth of the first jam incidence. The second predetermined amount Δ2 thus statistically found is also stored as an initially set value in the storage portion 63. Thus, in this embodiment the first and second predetermined amounts Δ1 and Δ2 stored in the storage portion 63 are previously determined as initially set values.

Back in FIG. 5, the flow of control continues as follows. If the amount of skewing exceeds the second predetermined amount Δ2 ("Yes" at step #7), the control portion 6 checks whether or not to continue, following the sheet P having an amount of skewing equal to or more than the second predetermined amount Δ2, feeding of any more sheets, that is, whether or not there still remains a job (step #8). If there remains a job ("Yes" at step #8), the control portion 6 continues printing but makes a setting to delay the timing of sheet feeding from the sheet feeding portion 4*a* until the sheet P having an amount of skewing equal to or more than the second predetermined amount Δ2 is ejected (step #9). The aim is, from the viewpoint of alleviating jam recovery work on occurrence of a jam during continuous printing, to reduce the number of sheets inside the apparatus.

Specifically, when the amount of skewing grasped by use of the skew amount detection sensors 8 is equal to or more than the second predetermined amount Δ2 stored in the storage portion 63 and smaller than the first predetermined amount Δ1 but is less than the first predetermined amount Δ1, the control portion 6 delays the timing of sheet feeding from the sheet feeding portion 4*a* as compared with that when the amount of skewing is less than the second predetermined amount Δ2. The only requirement here is that less sheets than normally be conveyed inside the apparatus, with at least only one sheet being conveyed inside the apparatus. By contrast, if there remains no job ("No" at step #8), sheet conveyance is continued until the sheet P is ejected into the ejected sheet tray 43 (step #10), and sheet conveyance control is ended ("END").

On the other hand, if the amount of skewing does not exceed the second predetermined amount Δ2 ("No" at step #7), whether or not there still remains a job is checked (step #11), and if there remains a job ("Yes" at step #11), a return is made to step #1. If there remains no job ("No" at step #11), an advance is made to step #10.

(Detection of Constant Occurrence of Skewing)

Figure 7A:
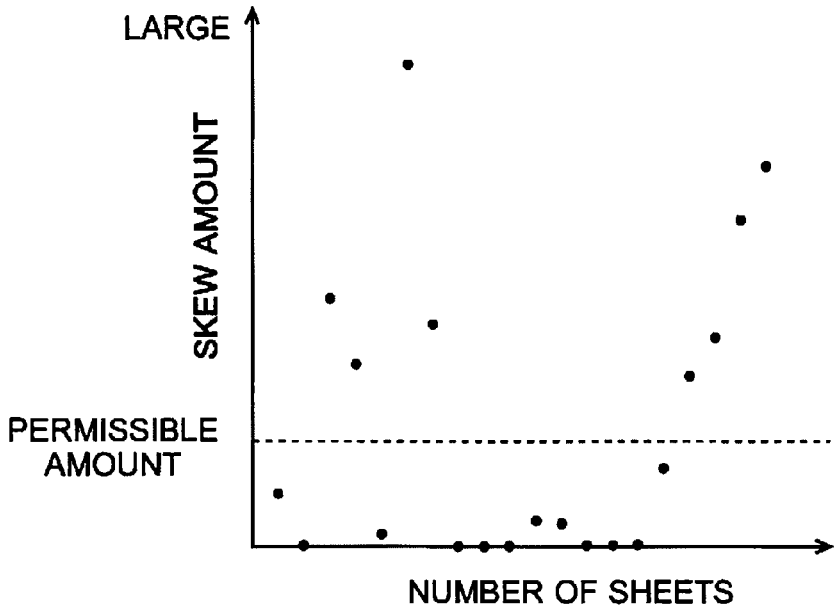
FIG. 7A is a scatter diagram showing an example of the amount of skewing during printing.
Figure 7B:
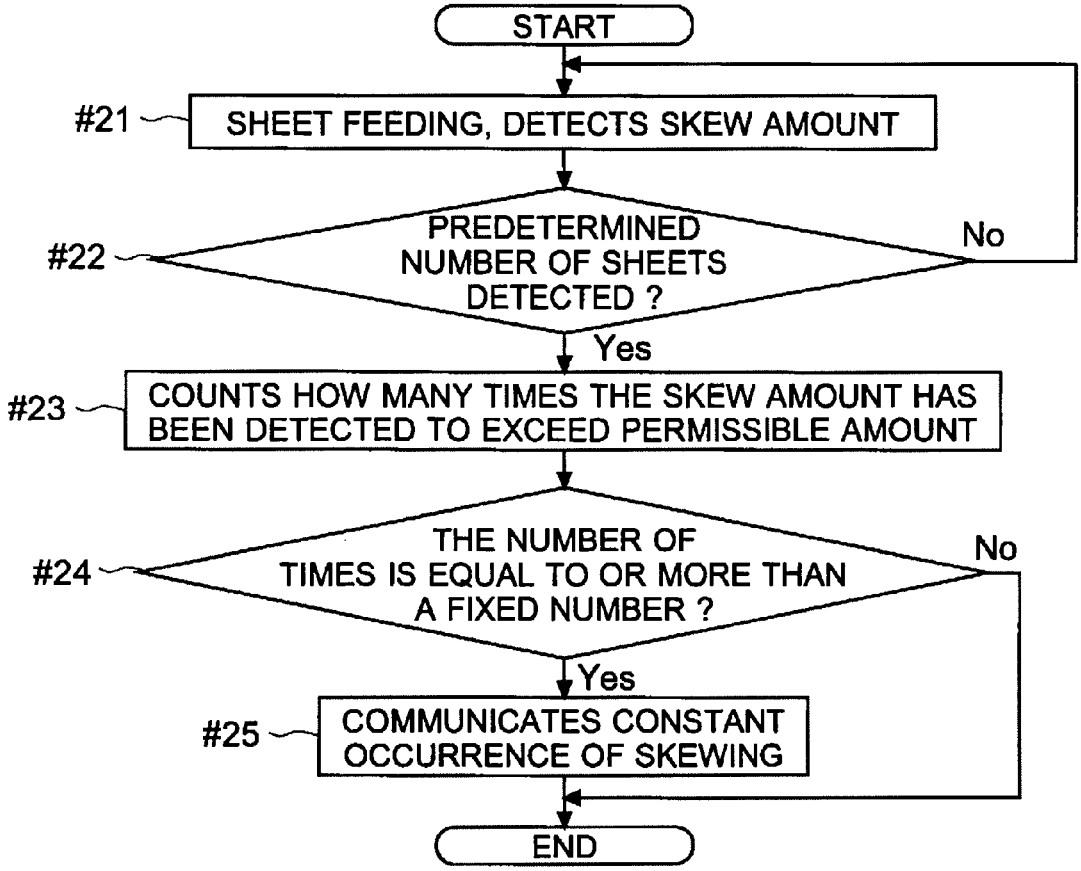
FIG. 7B is a flow chart showing an example of control for automatic detection of necessity for repair and checks on the MFP according to the first embodiment.

Next, with reference to FIGS. 7A and 7B, a description will be given of automatic detection of necessity for repair and checks on the MFP 1 according to the first embodiment of the invention. FIG. 7A is a scatter diagram showing an example of the amount of skewing during printing. FIG. 7B is a flow chart showing an example of control for automatic detection of necessity for repair and checks on the MFP 1 according to the first embodiment of the invention.

Generally, the maintenance of the MFP 1, to cope with secular deterioration and faults, is carried out by a serviceperson dispatched from the manufacturer or one of its affiliated companies (as under a maintenance contract). A serviceperson periodically visits the site where the MFP 1 is installed to carry out maintenance. In maintenance, the serviceperson checks, for example, how skewed sheets P are.

The MFP 1 of this embodiment, however, has the skew amount detection sensors 8 and thus can detect constant occurrence of skewing of the sheets P. Constant occurrence of skewing leads to a high jam incidence and is therefore undesirable. Moreover, constant occurrence of skewing may result from any of the rotary members such as the sheet feed rollers 42 deviating from being parallel to the plane of sheets P, or any of the rotary members having worn out to the end of its lifetime. Accordingly, the control portion 6 in this embodiment checks, for example, whether or not the amount of skewing detected by the skew amount detection sensors 8 is equal to or more than a permissible amount. Furthermore, based on whether or not the number of times that the amount of skewing is equal to or more than the permissible amount every predetermined number of sheets is equal to or more than a fixed number, the control portion 6 checks for constant occurrence of skewing. An example of this technique will now be described with reference to FIG. 7A.

In the scatter diagram in FIG. 7A, taken along the horizontal axis is the place in order of a sheet among a predetermined number of sheets (with the first one at the left end). Here, the predetermined number is assumed to be 20, and accordingly 20 points are plotted in the scatter diagram. The predetermined number is not limited to 20, and may be set as necessary in the range of several to several hundred. Then, as shown in FIG. 7A, the permissible amount of skewing is determined.

The permissible amount can be determined as necessary. For example, generally, when the amount of skewing exceeds a fixed amount (e.g., 1 mm), the user is likely to notice misplaced printing. Accordingly, from the viewpoint of image quality, for the permissible amount, a fixed amount (e.g., 1 mm) may be taken as a reference. Instead, the permissible amount may be determined from the viewpoint of jam incidence (e.g., 0.1% or less). For example, the amount of skewing with which the incidence of jams is expected to be 0.1% or less may be taken as the permissible amount. The control portion 6 then measures the amount of skewing with respect to each sheet P fed, and counts the times that the amount of skewing exceeds the permissible amount per a predetermined number of sheets. The count with which constant occurrence of skewing is recognized is also determined arbitrarily (e.g., 10% or more, or 20% or more, of the predetermined number). The data related to the predetermined number, the permissible amount, and the number of times at which constant occurrence of skewing is recognized is, along with programs, stored in the storage portion 63.

When the control portion 6 recognizes constant occurrence of skewing, it can communicate it via the I/F portion 65 (see FIG. 3). Here, the I/F portion 65 of this embodiment is connected to a public communications network (e.g., a telephone network). Thus, from the I/F portion 65, constant occurrence of skewing can be communicated to an apparatus (e.g., a PC, a facsimile machine, or a serviceperson's cellular phone) of the company that carries out maintenance of the MFP 1. Specifically, when skewing is recognized to be constantly occurring, the control portion 6, by use of the I/F portion 65 for communication with an external apparatus, communicates constant occurrence of skewing from the I/F portion 65 to an external apparatus that accepts a request for maintenance. This enables a serviceperson to recognize necessity for maintenance. Moreover, indicating constant occurrence of skewing on the liquid crystal display portion 21 on the operation panel 2 enables the user to recognize necessity for maintenance. Specifically, the control portion 6 makes the liquid crystal display portion 21, which displays the state of the apparatus, display an indication that skewing is constantly occurring. The I/F portion 65 may notify the user terminal 100 to indicate constant occurrence of skewing on the display of the user terminal 100.

An example of control for automatic detection of necessity for repair and checks on the MFP 1 will now be described with reference to FIG. 7B. The "START" in FIG. 7B is when the first of a predetermined number of sheets starts to be printed. First, a sheet P is fed from the sheet feeding portion 4*a*, and the control portion 6 detects the amount of skewing (step #21). Next, the control portion 6 checks whether or not the amount of skewing has been detected with respect to the predetermined number of sheets (step #22). If not ("No" at step #22), a return is made to step #21; by contrast, if so ("Yes" at step #22), how many times the amount of skewing has been detected to exceed the permissible amount is counted (step #23).

Next, the control portion 6 checks whether or not the number of times that the amount of skewing has been detected to exceed the permissible amount is equal to or more than a fixed number (step #24). If the number of times so detected is equal to or more than the fixed number ("Yes" at step #24), the control portion 6 makes the I/F portion 65 and the liquid crystal display portion 21 communicate constant occurrence of skewing (step #25). After step #25, or if the number of times is less than the fixed number ("No" at step #24), the control is ended ("END") for the moment, and is restarted as necessary (starting at "START" again).

With a large amount of skewing of sheets P, a jam is highly likely to occur in the future; in addition, once a jam occurs, it tends to be severe, causing a sheet P to be torn or remain inside the apparatus for instance. With the above configuration, however, when the amount of skewing obtained by use of the skewing detector (the skew amount detection sensors 8) is equal to or more than the first predetermined amount Δ1, the control portion 6 stops printing. Thus, conveyance of sheets P can be stopped before a jam occurs. When a jam is detected, generally, printing is stopped, and, in fact, printing is stopped in the present invention, but here printing is stopped before a sheet P gets stuck inside the conveyance passage 4*b* or at a rotary member for sheet conveyance (e.g., with the sheet P torn, or stuck in a bellows-like state) in a way difficult to remove. This allows easy removal of the sheet P, and leads to a low jam incidence.

When a severe jam occurs, part of a torn sheet P may remain deep inside the apparatus and keep being detected by a sensor or the like. This may make it impossible to revoke the jam state, or may cause a further jam. When this happens, the image forming apparatus (e.g., the MFP 1) continues being inoperative. Inconveniently, the user then needs to call a maintenance serviceperson for recovery. With the present invention, however, severe jams are unlikely to occur, and thus there is less likelihood of inoperativeness and less need to call a serviceperson, leading to increased convenience to the user.

On the downstream side of the image forming portion 5*a*, there are provided many mechanisms for printing. A jam in a printing mechanism tends to take time and trouble for recovery from it. The skewing detector, however, is provided on the upstream side of the image forming portion 5*a* with respect to the sheet conveyance direction. This makes it possible to stop printing before a jam occurs on the downstream side of the image forming portion 5*a*. Moreover, a construction for preventing a jam can be built with a skewing detector, a control portion 6, etc., and there is no need for an expensive, space-consuming construction as required for moving guide members for instance. Thus, the present invention can be implemented at low cost.

When the amount of skewing obtained by use of the skewing detector (the skew amount detection sensors 8) is equal to or more than the second predetermined amount Δ2 stored in the storage portion 63 and smaller than the first predetermined amount Δ1 but is less than the first predetermined amount Δ1, the control portion 6 delays the timing of sheet feeding from the sheet feeding portion 4*a* as compared with when the amount of skewing is less than the second predetermined amount Δ2 (i.e., normally). Then, when the amount of skewing is less than the first predetermined amount Δ1 and thus jam incidence is recognized to be low, printing is continued with priority given to convenience to the user. Even when a jam occurs, less sheets P are conveyed inside the apparatus, and this alleviates jam recovery work by the user.

The first predetermined amount Δ1 and/or the second predetermined amount Δ2 stored in the storage portion 63 are previously determined as initially set values based on the results of repeated experiments or the like. This makes it possible to surely prevent occurrence of jams. Moreover, no calculation is needed to determine the first and second predetermined amounts Δ1 and Δ2, and this alleviates the burden of calculation on the control portion 6.

The control portion 6 checks whether or not the amount of skewing detected by the skewing detector (the skew amount detection sensors 8) is equal to or more than the permissible amount, and checks for constant occurrence of skewing based on whether or not the times that the amount of skewing is equal to or more than the permissible amount is equal to or more than a fixed number. This makes it possible to self-detect constant occurrence of skewing automatically.

Thanks to provision of a communication portion (I/F portion 65) for communication with an external apparatus, when skewing is recognized to be constantly occurring, the control portion 6 makes the communication portion communicate constant occurrence of skewing to an external apparatus that accepts a request for maintenance. Constant occurrence of skewing of sheets P implies an abnormality in a member involved in sheet conveyance inside the apparatus, and tends to lead to a high jam incidence. With this configuration, however, the control portion 6 makes the communication portion communicate constant occurrence of skewing to an external apparatus that accepts a request for maintenance, and thus it is possible to achieve, in the form of a visit and checks by a serviceperson, early detection of an abnormality in, or adjustment or repair on, a member involved in paper conveyance.

Thanks to provision of a display portion (the liquid crystal display portion 21) displaying the state of the apparatus, when skewing is recognized to be constantly occurring, the control portion 6 makes the display portion (the liquid crystal display portion 21) display an indication that skewing is constantly occurring. Constant occurrence of skewing of sheets P implies an abnormality in a member involved in sheet conveyance inside the apparatus, and tends to lead to a high jam incidence. With this configuration, the control portion 6 makes the display portion (the liquid crystal display portion 21) display an indication that skewing is constantly occurring, and thus the user can recognize an abnormality in a member involved in paper conveyance, and necessity for adjustment and repair.

When the amount of skewing obtained by use of the skewing detector (the skew amount detection sensors 8) is equal to or more than the first predetermined amount Δ1 and printing is stopped, the control portion 6 makes the display portion display an indication that a sheet P having an amount of skewing equal to or more than the first predetermined amount Δ1 needs to be checked. With this configuration, the display portion (the liquid crystal display portion 21) displays an indication that a sheet P needs to be checked, and thus it is possible to prompt the user to remove a sheet P having a large amount of skewing and to check how sheets are placed in the sheet feeding portion 4*a*.

The skewing detector (the skew amount detection sensors 8) detects the difference between the times at which opposite edges of a sheet P reach the skewing detector, and the control portion 6 finds the amount of skewing based on the difference in time. This makes it possible to accurately grasp how skewed sheets P are.

Second Embodiment

Saving and Feedback of Skew Amount Measurement Results

Figure 8:
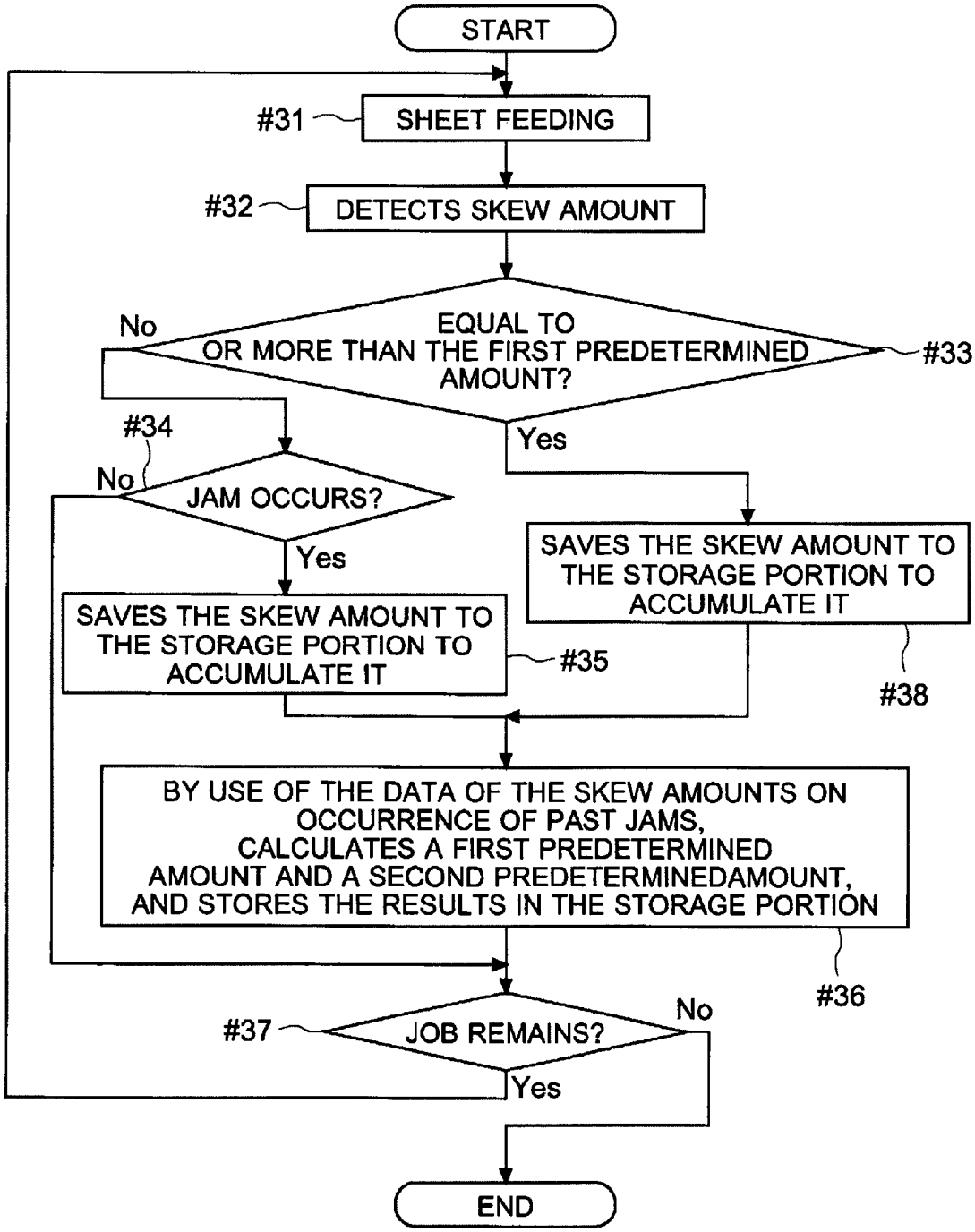
FIG. 8 is a flow chart showing an example of control for saving the result of measurement of the amount of skewing in a MFP according to a second embodiment of the invention and for feedback of the saved result.
Figure 9:
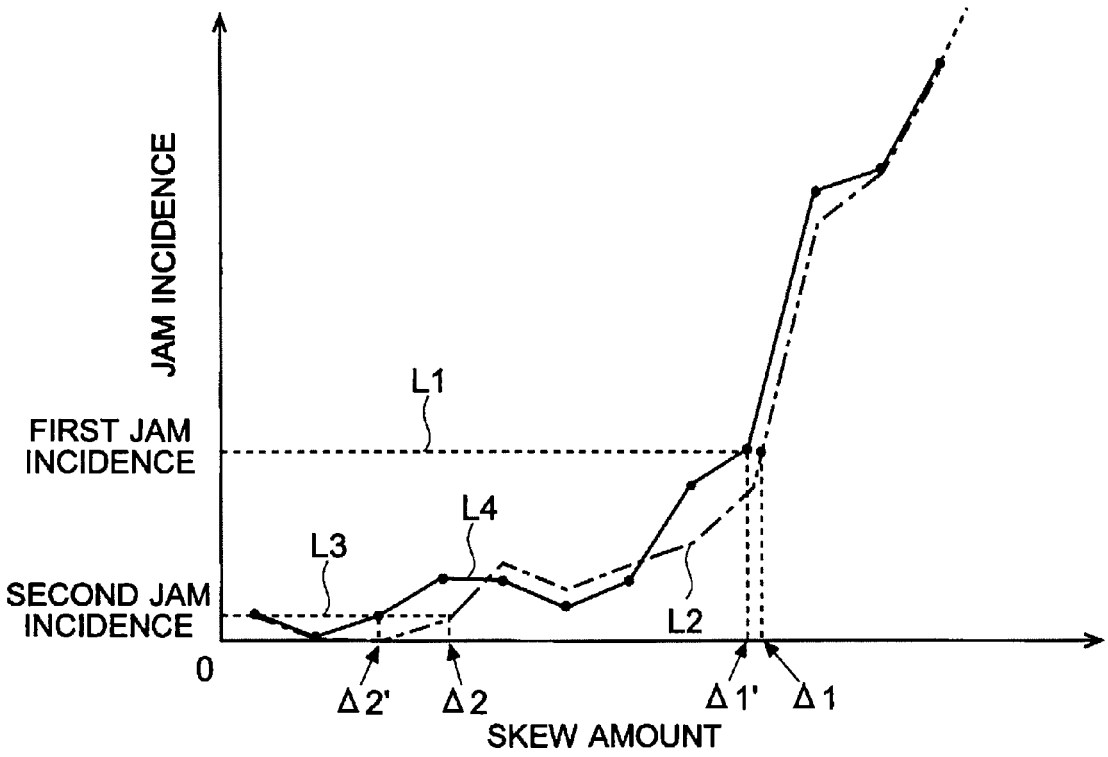
FIG. 9 is an example of a graph illustrating how first and second predetermined amounts and are determined according to the second embodiment.

Next, with reference to FIGS. 8 and 9, a description will be given of how the first and second predetermined amounts Δ1 and Δ2 are determined in an MFP 1 according to a second embodiment of the invention. FIG. 8 is a flow chart showing an example of control for saving the result of measurement of the amount of skewing in the MFP 1 according to the second embodiment of the invention and for feedback of the saved result. FIG. 9 is an example of a graph illustrating how the first and second predetermined amounts Δ1 and Δ2 are determined according to the second embodiment of the invention.

In the first embodiment, the first and second predetermined amounts Δ1 and Δ2 are determined based on data obtained through experiments or the like. These predetermined amounts are stored, as previously determined initially set values, in the storage portion 63. However, depending on various factors, such as the environment in which the MFP 1 is installed and the degree of wear of the sheet feed rollers 42, the relationship between jam incidence and skew amount varies to a certain degree among individuals. To cope with this, in this embodiment, the amount of skewing on occurrence of a jam is saved, and such saved results are accumulated for prediction of jam incidence. That is, the amount of skewing measured on occurrence of a jam is fed back for use in determination of the first and second predetermined amounts Δ1 and Δ2. This allows the initially set values to be changed, with a possible result of more effective prevention of severe jams and enhancement of convenience to the user.

This aspect will now be described with reference to FIGS. 8 and 9. The difference between the first and second embodiments is whether to use as the first and second predetermined amounts Δ1 and Δ2 the initially set values or to determine them by use of accumulated and saved data of the amounts of skewing on occurrence of jams. In other respects, such as the construction of the MFP 1 and of the sensors, the first and second embodiments are similar, and such similar features will be omitted from description and illustration. For example, sheet conveyance control itself is performed according to FIG. 5, which was described in connection with the first embodiment. In other words, the control shown in FIG. 8 is performed parallel to the control in FIG. 5.

The "START" in FIG. 8 is when printing is started. The control portion 6 then makes the sheet feeding portion 4*a* feed a sheet (step #31). Next, the control portion 6 detects the amount of skewing by use of the skew amount detection sensors 8 (step #32). Next, the detected amount of skewing is equal to or more than the first predetermined amount Δ1 is checked (step #33). If it does not exceed the first predetermined amount Δ1 ("No" at step #33), the control portion 6 then checks whether or not the sheet P jams (step #34).

If a jam occurs ("Yes" at step #34), the control portion 6 saves the amount of skewing of the jammed sheet P to the storage portion 63 to accumulate it (step #35). So that the data of the amounts of skewing on occurrence of past jams may be used to predict occurrence of a jam and the prediction may be fed back, the control portion 6 (the CPU 61), by use of the data of the amounts of skewing on occurrence of past jams, calculates a first predetermined amount Δ1' corresponding to a jam incidence equal to or higher than the first jam incidence (see FIGS. 6 and 9) and a second predetermined amount Δ2' corresponding to a jam incidence equal to or higher than the second jam incidence (see FIGS. 6 and 9), and stores the results, as new first and second predetermined amounts Δ1 and Δ2, in the storage portion 63 (step #36) (the details will be described later).

If no jam occurs ("No" at step #34), or after step #36, the control portion 6 checks whether or not there still remains a job (whether or not to feed another sheet) (step #37). If there remains a job ("Yes" at step #37), a return is made to step #31. If there remains no job ("No" at step #37), calculations and control related to saving and feedback of skew amount measurement results are ended ("END").

On the other hand, if the detected amount of skewing is equal to or more than the first predetermined amount Δ1 ("Yes" at step #33), the control portion 6 saves the amount of skewing of the sheet P to the storage portion 63 (step #38). In this case, printing, including sheet conveyance, is stopped, and the user does recovery work such as removal of the sheet from the conveyance passage 4*b* (see FIG. 5).

In the invention of this embodiment, when an amount of skewing more than the first predetermined amount Δ1 is detected, the control portion 6 stops printing to prevent a jam. Thus, when an amount of skewing more than the first predetermined amount Δ1 is detected, in practice, no jam occurs. However, when detection of an amount of skewing more than the first predetermined amount Δ1 is counted as no jam, no incidence of jams is recognized at or above the first predetermined amount Δ1, and this makes it impossible to predict occurrence of a jam accurately. To avoid this, when an amount of skewing more than the first predetermined amount Δ1 is detected, step #38 is executed to assume that a jam has occurred. Thereafter, an advance is made to step #36. When step #38 is gone through, printing is stopped, and thus reprinting is necessary; thus, at step #37, basically "Yes" is selected.

Next, with reference to the graph shown in FIG. 9, a description will be given of determination of the first and second predetermined amounts based on feedback of the amounts of skewing on occurrence of jams saved and accumulated in the storage portion 63.

In FIG. 9, the line L2 indicated by a dash-dot line represents the relationship between skew amount and jam incidence with the initial settings shown in FIG. 6B. And the line L4 indicated by a solid line represents an example of the relationship between skew amount and jam incidence as created by calculation, in a manner similar to in the case shown in FIG. 6B, based on feedback of accumulated amounts of skewing on occurrence of jams. This line L4 is determined by the CPU 61, which calculates it every time a jam occurs while referring to the data of accumulated amounts of skewing on occurrence of jams.

Comparing L4 with L2 shows that the amount of skewing (the first predetermined amount) corresponding to a jam incidence equal to or higher than the first jam incidence has moved from Δ1 to Δ1', and the amount of skewing (the second predetermined amount) corresponding to a jam incidence equal to or higher than the second jam incidence has moved from Δ2 to Δ2'. The MFP 1 of this embodiment stores, in the storage portion 63, in place of the initially or previously set values, the values of Δ1' and the Δ2' obtained through prediction of calculation a jam incidence based on past data. The MFP 1 then uses Δ1' and Δ2' as new first and second predetermined amounts Δ1 and Δ2.

Here, so that the first predetermined amounts Δ1 and Δ2 may be determined and changed accurately, a certain amount of data of the amounts of skewing on occurrence of jams is necessary. Accordingly, for example, a starting condition may be determined under which to start calculation and determination of the first and second predetermined amounts Δ1 and Δ2 based on data of the amounts of skewing on occurrence of past jams. Until the stating condition is fulfilled, the first and second predetermined amounts Δ1 and Δ2 determined in the initial setting described in connection with the first embodiment may be used. The starting condition may be, for example, completion of printing on several thousand to several tens of thousands of sheets, or occurrence of ten and several to several tens of jams.

Various kinds of data (the cumulative number of sheets printed, the amounts of skewing on occurrence of jams, and the jam incidence during experiments) from which to derive initial settings may be stored in the storage portion 63. Then, every time a jam occurs, the control portion 6 re-calculates the amounts of skewing corresponding to a jam incidence equal to or higher than the first and second jam incidences to correct and fine-adjust the first and second predetermined amounts Δ1 and Δ2 one after the other. The first and second predetermined amounts Δ1 and Δ2 may be calculated and determined in this way.

Thus, according to this embodiment, the MFP 1 comprises a sheet detector (the sheet sensors 7) that detects arrival and departure of sheets P; the control portion 6 detects jams by use of a skewing detector (the skew amount detection sensors 8) and the sheet detector; the storage portion 63 stores the amounts of skewing of sheets P that have caused the jams and the cumulative number of sheets printed; the control portion 6 calculates, based on the amounts of skewing of sheets P that have caused the jams and the cumulative number of sheets printed as stored in the storage portion 63, jam incidences versus skew amounts, then finds, based on the calculation results, an amount of skewing corresponding to a jam incidence equal to or higher than the previously determined first jam incidence, and takes the thus found amount of skewing as a first predetermined amount Δ1. Thus, the first predetermined amount Δ1 is found based on predicted jam incidence, and this makes it possible, while eliminating differences among individual image forming apparatuses (e.g., the MFP 1), to reduce occurrence of jams.

The control portion 6 also finds, based on the calculation results of jam incidences, an amount of skewing corresponding to a jam incidence equal to or higher than the previously determined second jam incidence, and takes the thus found amount of skewing as a second predetermined amount Δ2. With this configuration, based on the calculation results of jam incidences, an amount of skewing corresponding to a jam incidence equal to or higher than the previously determined second jam incidence is found, and the thus found amount of skewing is taken as a second predetermined amount Δ2. Thus, the second predetermined amount Δ2 can be determined to suit how jams occur in different image forming apparatuses (e.g., the MFP 1).

The embodiments of the present invention described above are in no way meant to limit the scope of the invention, which can thus be carried out with many variations and modifications made without departing from the spirit of the invention.

What is claimed is:

1. An image forming apparatus comprising:

a sheet feeding portion accommodating a plurality of sheets as a recording medium, the sheet feeding portion feeding a sheet;

a conveyance passage through which the sheet is conveyed inside the apparatus;

an image forming portion forming an image on the sheet;

a skewing detector disposed in the conveyance passage between the sheet feeding portion and the image forming portion, the skewing detector detecting arrival and departure of the sheet, the skewing detector detecting an amount of skewing of the sheet in the conveyance passage;

a storage portion storing data; and a control portion controlling sheet feeding and sheet conveyance, the control portion grasping the amount of skewing of the sheet based on an output of the skewing detector and stopping printing when the amount of skewing is equal to or more than a first predetermined amount stored in the storage portion, wherein, when the amount of skewing grasped by use of the skewing detector is equal to or more than a second predetermined amount stored in the storage portion and smaller than the first predetermined amount but is less than the first predetermined amount, the control portion delays timing of sheet feeding from the sheet feeding portion as compared with when the amount of skewing is less than the second predetermined amount.

2. The image forming apparatus according to claim 1, further comprising:

a sheet detector detecting arrival and departure of the sheet, wherein the control portion detects occurrence of a jam by use of the skewing detector and the sheet detector;

the storage portion stores amounts of skewing of sheets that have caused jams and cumulative number of sheets printed; and the control portion calculates, based on the amounts of skewing of the sheets that have caused the jams and the cumulative number of sheets printed as stored in the storage portion, jam incidences versus skew amounts, then finds, based on calculation results, an amount of skewing corresponding to a jam incidence equal to or higher than a previously determined first jam incidence, and takes the thus found amount of skewing as the first predetermined amount.

3. The image forming apparatus according to claim 2, wherein the control portion finds, based on the calculation results of jam incidences, an amount of skewing corresponding to a jam incidence equal to or higher than a previously determined second jam incidence, and takes the thus found amount of skewing as the second predetermined amount.

4. The image forming apparatus according to claim 1, wherein the first predetermined amount stored in the storage portion is previously determined as an initially set value.

5. The image forming apparatus according to claim 1, wherein the second predetermined amount stored in the storage portion is previously determined as an initially set value.

6. The image forming apparatus according to claim 1, wherein the control portion checks whether or not the amount of skewing detected by the skewing detector is equal to or more than a permissible amount, and recognizes whether or not number of times that the amount of skewing is equal to or more than the permissible amount every predetermined number of sheets is equal to or more than a fixed number.

7. The image forming apparatus according to claim 6, further comprising:

a communication portion for communication with an external apparatus, wherein, when skewing is recognized to be constantly occurring, the control portion makes the communication portion communicate constant occurrence of skewing to an external apparatus that accepts a request for maintenance.

8. The image forming apparatus according to claim 6, further comprising:

a display portion displaying a state of the apparatus, wherein, when skewing is recognized to be constantly occurring, the control portion makes the display portion display an indication that skewing is constantly occurring.

9. The image forming apparatus according to claim 8, wherein, when the amount of skewing obtained by use of the skewing detector is equal to or more than the first predetermined amount and printing is stopped, the control portion makes the display portion display an indication that the sheet having the amount of skewing equal to or more than the first predetermined amount needs to be checked.

10. The image forming apparatus according to claim 1, wherein the skewing detector detects a difference between times at which opposite edges of the sheet reach the skewing detector, and the control portion finds an amount of skewing based on the difference in time.

* * * * *